US010601134B2

(12) United States Patent
Kim et al.

(10) Patent No.: US 10,601,134 B2
(45) Date of Patent: Mar. 24, 2020

(54) ANTENNA DEVICE AND APPARATUS INCLUDING THE SAME

(71) Applicant: WITS Co., Ltd., Yongin-si, Gyeonggi-do (KR)

(72) Inventors: Hee Seung Kim, Suwon-si (KR); Gie Hyoun Kweon, Suwon-si (KR); Dae Kyu Lee, Suwon-si (KR); Jae Gen Eom, Suwon-si (KR); Jae Sun Won, Suwon-si (KR); Soon Joung Yio, Suwon-si (KR); Young Seung Roh, Suwon-si (KR)

(73) Assignee: WITS Co., Ltd., Gyeonggi-do (KR)

( * ) Notice: Subject to any disclaimer, the term of this patent is extended or adjusted under 35 U.S.C. 154(b) by 0 days.

(21) Appl. No.: 16/021,506

(22) Filed: Jun. 28, 2018

(65) Prior Publication Data

US 2019/0173181 A1 Jun. 6, 2019

(30) Foreign Application Priority Data

Dec. 6, 2017 (KR) ..... 10-2017-0166974

(51) Int. Cl.

| | |
|---|---|
| ***H01Q 7/06*** | (2006.01) |
| ***H01Q 1/24*** | (2006.01) |
| ***H01Q 21/28*** | (2006.01) |
| ***H01Q 7/08*** | (2006.01) |
| *H01Q 21/06* | (2006.01) |

(52) U.S. Cl.

CPC ..... *H01Q 7/06* (2013.01); *H01Q 1/243* (2013.01); *H01Q 7/08* (2013.01); *H01Q 21/28* (2013.01); *H01Q 21/061* (2013.01)

(58) Field of Classification Search

USPC ..... 343/788

See application file for complete search history.

(56) References Cited

U.S. PATENT DOCUMENTS

| | | | | |
|---|---|---|---|---|
| 9,960,628 | B2 * | 5/2018 | Peralta | H02J 5/005 |
| 9,991,721 | B2 * | 6/2018 | Jin | H01F 17/0006 |
| 10,050,677 | B1 * | 8/2018 | Thoen | H04B 5/0081 |
| 10,222,433 | B2 * | 3/2019 | Leussler | G01R 33/3415 |

FOREIGN PATENT DOCUMENTS

| | | | |
|---|---|---|---|
| JP | 2009-503940 | A | 1/2009 |
| KR | 10-2004-0061607 | A | 7/2004 |
| WO | WO 2007/011934 | A2 | 1/2007 |

* cited by examiner

*Primary Examiner* — Brian K Young

(74) *Attorney, Agent, or Firm* — Harness, Dickey & Pierce, P.L.C.

(57) ABSTRACT

An antenna device includes: a substrate including a base layer, a first layer disposed on one surface of the base layer, a second layer disposed on another surface of the base layer, at least one first coil pattern disposed on the first layer, and at least one second coil pattern disposed on the second layer; and a magnetic body. A first region of the substrate is disposed on one surface of the magnetic body, and a second region of the substrate is disposed on another surface of the magnetic body. The at least one first coil pattern and the at least one second coil pattern are connected to each other to form an antenna coil having a solenoid shape disposed around the magnetic body.

20 Claims, 15 Drawing Sheets

ANTENNA DEVICE AND APPARATUS INCLUDING THE SAME

CROSS-REFERENCE TO RELATED APPLICATIONS

This application claims the benefit under 35 U.S.C. § 119(a) of Korean Patent Application No. 10-2017-0166974 filed on Dec. 6, 2017 in the Korean Intellectual Property Office, the entire disclosure of which is incorporated herein by reference for all purposes.

BACKGROUND

1. Field

The following description relates to an antenna device for transmitting or receiving data, and an apparatus including the antenna device.

2. Description of Related Art

An antenna device may be a device used for transmitting, receiving, or transmitting and receiving data, and may have a solenoid shape or a spiral shape. Apparatuses may transmit various types of data through such an antenna device. For example, an apparatus such as a smartphone may include an antenna device, and may transmit encrypted payment information through the antenna device using a magnetic secure transfer (MST) scheme.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna device includes: a substrate including a base layer, a first layer disposed on one surface of the base layer, a second layer disposed on another surface of the base layer, at least one first coil pattern disposed on the first layer, and at least one second coil pattern disposed on the second layer; and a magnetic body. A first region of the substrate is disposed on one surface of the magnetic body, and a second region of the substrate is disposed on another surface of the magnetic body. The at least one first coil pattern and the at least one second coil pattern are connected to each other to form an antenna coil having a solenoid shape disposed around the magnetic body.

The at least one first coil pattern and the at least one second coil pattern may be arranged in a first direction. The substrate may further include at least one slit extending in a second direction different from the first direction. The magnetic body may pass through the at least one slit.

The substrate may further include protective holes formed at two ends of the at least one slit.

Either one or both of the at least one first coil pattern and the at least one second coil pattern may include an intermediate part and an end part that is narrower than the intermediate part.

The substrate may further include at least one protective pattern extending in the first direction and formed on the first layer or the second layer.

The at least one first coil pattern may be formed in the first region, and the at least one second coil pattern may be formed in the second region.

The at least one first coil pattern and the at least one second coil pattern may each include a main pattern extending in the second direction, and one or more connection patterns extending in the first direction from at least one end of the main pattern.

Each of the one or more connection patterns of the first coil pattern may be connected to a corresponding one of the one or more connection patterns of the second coil pattern through a via.

The first coil pattern may include a first pattern formed in the first region and a second pattern formed in the second region. The second coil pattern may include a third pattern formed in the first region and a fourth pattern formed in the second region.

The first pattern and the fourth pattern may be connected to each other through a first via, and the second pattern and the third pattern may be connected to each other through a second via.

The first pattern and the second pattern may be connected to each other by a first connection pattern formed on the first layer, and the third pattern and the fourth pattern may be connected to each other by a second connection pattern formed on the second layer.

In another general aspect an apparatus includes: a main body; a cover covering a rear surface of the main body; and an antenna device disposed inside the cover. The antenna device includes: a substrate including a base layer, a first layer disposed on one surface of the base layer, a second layer disposed on another surface of the base layer, at least one first coil pattern disposed on the first layer, and at least one second coil pattern disposed on the second layer; and a magnetic body. A first region of the substrate is disposed on one surface of the magnetic body, and a second region of the substrate is disposed on another surface of the magnetic body. The at least one first coil pattern and the at least one second coil pattern are connected to each other to form an antenna coil having a solenoid shape disposed around the magnetic body.

The cover may be formed of metal.

The antenna device may be configured to transmit data in a magnetic secure transfer scheme.

The at least one first coil pattern and the at least one second coil pattern may be arranged in a first direction. The substrate may further include at least one slit extending in a second direction different from the first direction. The magnetic body may pass through the at least one slit.

Either one or both of the at least one first coil pattern and the at least one second coil pattern may include an intermediate part and an end part that is narrower than the intermediate part.

In another general aspect, an antenna coil includes: a base layer; a first layer disposed on a first surface of the base layer; a second layer disposed on another surface of the base layer opposite the first surface of the base layer; first coil patterns disposed on the first layer; second coil patterns disposed on the second layer; and slits extending through the base layer, the first layer, and the second layer. The slits are configured to receive a magnetic body such that a first region of the substrate is configured to contact a first surface of the magnetic body, and a second region of the substrate is disposed on a second surface of the magnetic body opposite the first surface of the magnetic body. The first coil patterns and the second coil patterns are connected to each other and are configured to form the antenna coil in a solenoid shape disposed around the magnetic body.

Each the first coil patterns may be connected to a corresponding one of the second coil patterns through a via.

The base layer may be formed of an insulator, and the first and second layers may be formed of a conductor.

The first coil patterns and the second coil patterns may be arranged in a column in a first direction, and the slits may extend in a second direction transverse to the first direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
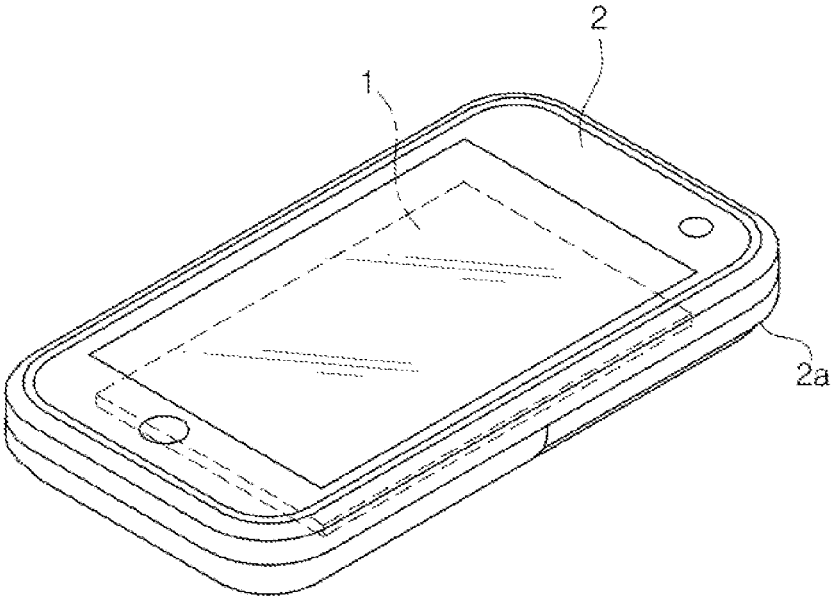
FIG. 1 is a diagram schematically showing a configuration of an apparatus including an antenna device, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a schematic view showing a configuration of an apparatus 2 including an antenna device 1, according to an embodiment. The apparatus 2 may be a mobile device including a cover 2*a* covering a rear surface of a main body. The cover may be formed of metal. The antenna device 1 may include an antenna coil having a solenoid shape. In addition, the antenna device 1 may transmit encrypted payment information using the magnetic secure transfer (MST) scheme. That is, the antenna device 1 may have a solenoid shape. Therefore, even when the cover 2*a* of the apparatus 2 is formed of metal, the apparatus 2 may appropriately transmit necessary information.

Figure 2:
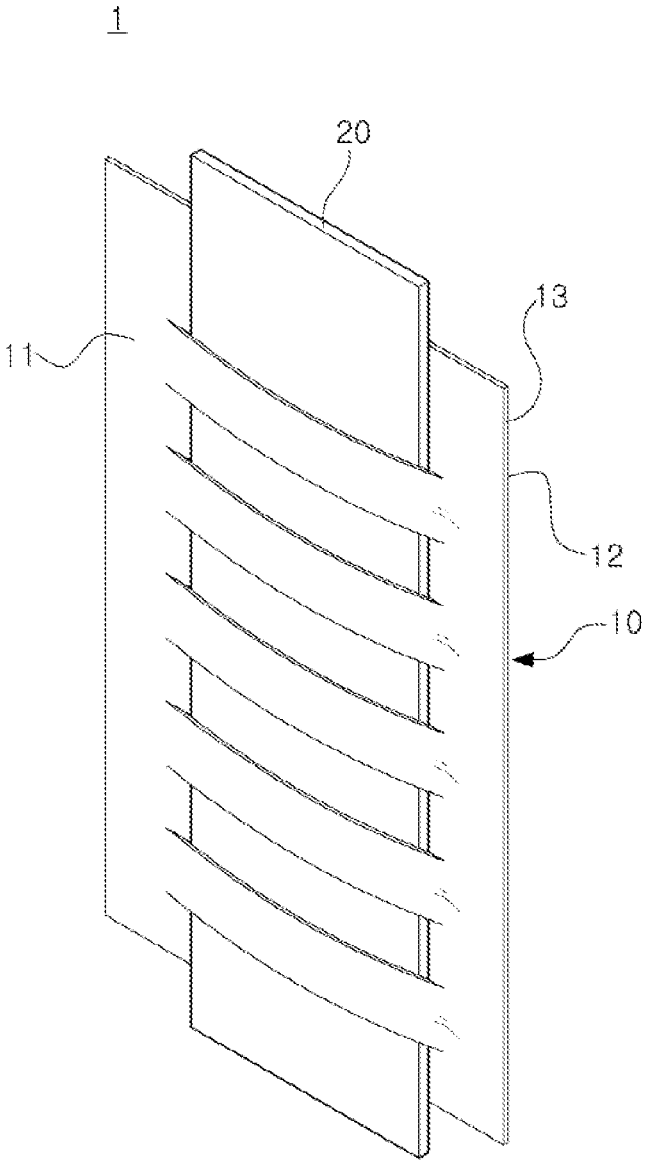
FIG. 2 is a diagram schematically showing a configuration of an antenna device, according to an embodiment.

FIG. 2 is a diagram schematically showing a configuration of the antenna device 1, according to an embodiment. Referring to FIG. 2, the antenna device 1 may include a substrate 10 and a magnetic body 20.

The substrate 10 may be a two-sided flexible printed circuit board (FPCB). That is, the substrate 10 may include a first layer 11 on which some of coil patterns are printed, a second layer 12 on which a remainder of the coil patterns are printed, and a base layer 13. The base layer 13 may be formed of an insulator such as polyimide. The first and second layers 11 and 12 may be formed of a conductor such as copper.

As shown in FIG. 2, a part of the substrate 10 may be disposed on one side of the magnetic body 20, and a part of the substrate 10 may be disposed on the other side of the magnetic body 20. In addition, the coil pattern formed on a part of the substrate 10 disposed on one side of the magnetic body 20 and the coil pattern formed on a part of the substrate 10 disposed on the other side of the magnetic body 20 may be connected to each other outside the magnetic body 20, such that the antenna coil having the solenoid shape may be formed.

As shown in FIG. 2, the magnetic body 20 may have a flat plate shape. However, the shape of the magnetic body 20 is not particularly limited.

Figure 3B:
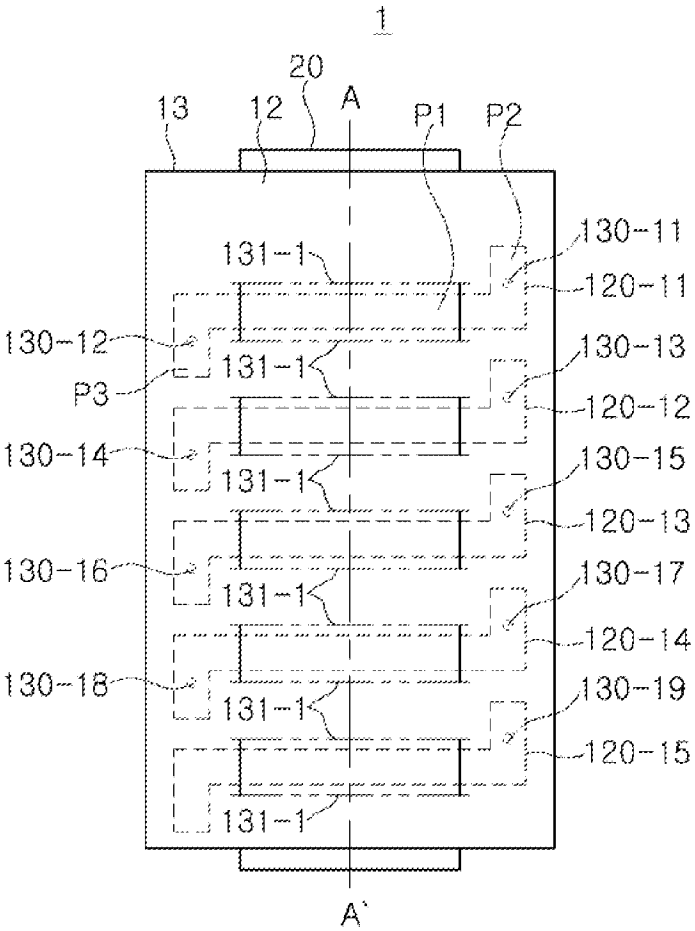
FIGS. 3A and 3B are diagrams schematically showing a coil pattern formed on a substrate of an antenna device, according to an embodiment.
Figure 3A:
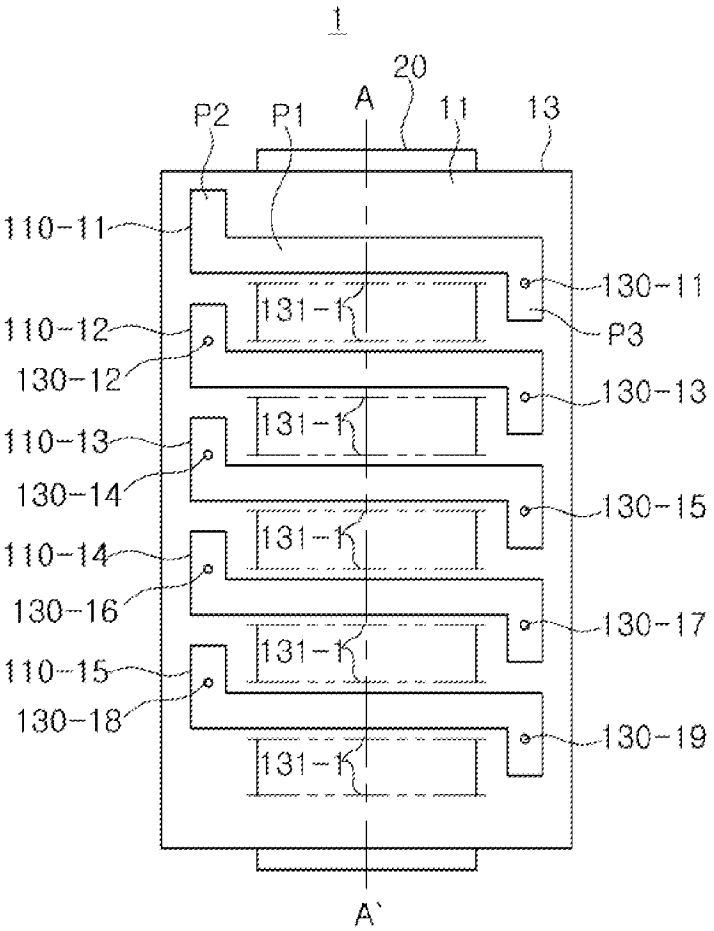

FIGS. 3A and 3B are diagrams schematically showing the coil pattern formed on the substrate 10 of the antenna device 1, according to an embodiment. Referring to FIGS. 3A and 3B, the substrate 10 may include the base layer 13, first coil patterns 110-11, 110-12, 110-13, 110-14, and 110-15 formed on the first layer 11 disposed on one side of the base layer 13, second coil patterns 120-11, 120-12, 120-13, 120-14, and 120-15 formed on the second layer 12 disposed on the other side of the base layer 13, vias 130-11, 130-12, 130-13, 130-14, 130-15, 130-16, 130-17, 130-18, and 130-19, and slits 131-1 through which the magnetic body 20 (FIG. 2) passes. As shown in FIGS. 3A and 3B, the first and second coil patterns 110-11, 110-12, 110-13, 110-14, 110-15, 120-11, 120-12, 120-13, 120-14, and 120-15 may be arranged (e.g., in a column) in a first direction, and the slits 131-1 may extend in a second direction different from the first direction.

In the drawings accompanying this specification, at least some of coil patterns represented by a solid line among the coil patterns may represent coil patterns formed on one surface of the magnetic body 20 (FIG. 2), and at least some of coil patterns represented by a dotted line among the coil patterns may represent patterns formed on the other surface of the magnetic material 20 (FIG. 2).

Further, in the drawings accompanying this specification, a two-dot chain line represents the slits through which the magnetic body 20 (FIG. 2) passes.

Still referring to FIGS. 3A and 3B, the first coil pattern 110-11 may be connected to the second coil pattern 120-11 through the via 130-11, the second coil pattern 120-11 may be connected to the first coil pattern 110-12 through the via 130-12, the first coil pattern 110-12 may be connected to the second coil pattern 120-12 through the via 130-13, the second coil pattern 120-12 may be connected to the first coil pattern 110-13 through the via 130-14, the first coil pattern 110-13 may be connected to the second coil pattern 120-13 through the via 130-15, the second coil pattern 120-13 may be connected to the first coil pattern 110-14 through the via 130-16, the first coil pattern 110-14 may be connected to the second coil pattern 120-14 through the via 130-17, the second coil pattern 120-14 may be connected to the first coil pattern 110-15 through the via 130-18, and the first coil pattern 110-15 may be connected to the second coil pattern 120-15 through the via 130-19. By the first and second coil patterns 110-11, 110-12, 110-13, 110-14, 110-15, 120-11, 120-12, 120-13, 120-14, and 120-15 being connected in the manner described above, a solenoid coil that surrounds the magnetic body 20 (FIG. 2) is formed.

Accordingly, a current flowing into the first coil pattern 110-11 may flow through the coil patterns in the order of the second coil pattern 120-11, the first coil pattern 110-12, the second coil pattern 120-12, the first coil pattern 110-13, the second coil pattern 120-13, the first coil pattern 110-14, the second coil pattern 120-14, the first coil pattern 110-15, and the second coil pattern 120-15.

In addition, as shown in FIGS. 3A and 3B, the first and second coil patterns 110-11, 110-12, 110-13, 110-14, 110-15, 120-11, 120-12, 120-13, 120-14, and 120-15 each may include a main pattern P1 extending in the second direction and connection patterns P2 and P3, which extend in the first direction from the main pattern and connected to other coil patterns through the vias 130-11, 130-12, 130-13, 130-14, 130-15, 130-16, 130-17, 130-18, and 130-19, respectively. The connection patterns may be located at both ends of the first and second coil patterns 110-11, 110-12, 110-13, 110-14, 110-15, 120-11, 120-12, 120-13, 120-14, and 120-15, respectively. That is, as shown in FIGS. 3A and 3B, the first and second coil patterns 110-11, 110-12, 110-13, 110-14, 110-15, 120-11, 120-12, 120-13, 120-14, and 120-15 each may include one main pattern P1 and two connection patterns P2 and P3 respectively formed at first and second ends of the main pattern, and the two connection patterns P2 and P3 may extend in opposite directions to each other with respect to the main pattern P1. That is, one connection pattern P2 may extend in one direction (upward direction in FIGS. 3A and 3B) from the main pattern P1, and the other connection pattern P3 may extend in the other direction (downward direction in FIGS. 3A and 3B) from the main pattern P1. The main patterns P1 may be formed between the slits 131-1 and the connection patterns P2 and P3 may be formed at an outside of both ends of the slits 131.

In FIGS. 3A and 3B, the slits 131-1 and the main patterns P1 of each of the first and second coil patterns 110-11, 110-12, 110-13, 110-14, 110-15, 120-11, 120-12, 120-13, 120-14, and 120-15 may extend in parallel with each other, the direction in which the first and second coil patterns 110-11, 110-12, 110-13, 110-14, 110-15, 120-11, 120-12, 120-13, 120-14, and 120-15 are arranged and the direction in which the main patterns P1 extend may be orthogonal to each other, and the direction in which the main patterns P1 extend and the direction in which the connection patterns P2 and P3 extend may be orthogonal to each other. However, the disclosure is not limited to this configuration. That is, the arrangement of elements, such as the angle between the respective coil patterns, main patterns, connection patterns, and the slits may be variously changed.

Figure 4:
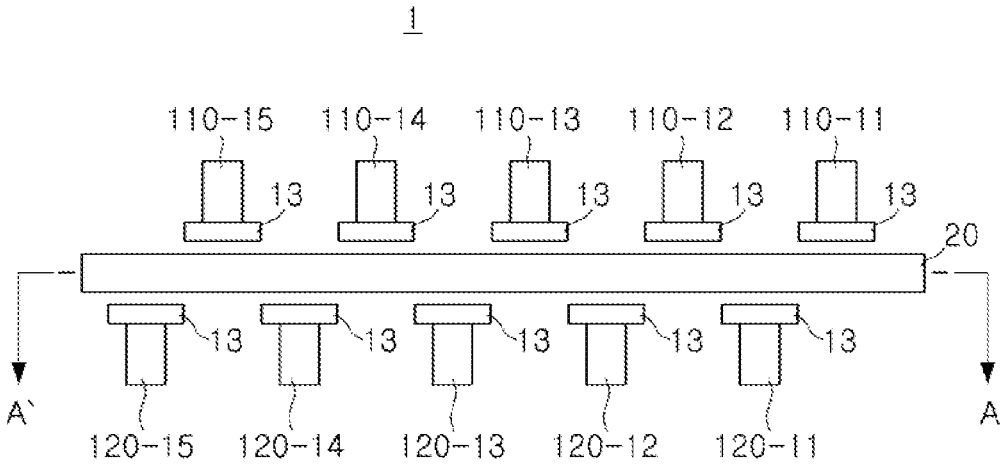
FIG. 4 is a diagram schematically showing a cross section of the antenna device, according to an embodiment.

FIG. 4 is a diagram schematically showing a cross section of the antenna device 1, taken along the line A-A' of FIGS. 3A and 3B.

As shown in FIG. 4, a part of the substrate 10, that is, the first coil patterns 110-11, 110-12, 110-13, 110-14, and 110-15, and a part of a base layer 13 on which the first coil patterns 110-11, 110-12, 110-13, 110-14, and 110-15 are formed may be formed on one side of the magnetic body 20. The other part of the substrate 10, that is, the second coil patterns 120-11, 120-12, 120-13, 120-14, and 120-15, and a part of the base layer 13 on which the second coil patterns 120-11, 120-12, 120-13, 120-14, and 120-15 are formed may be formed on the other side of the magnetic body 20.

Figure 5B:
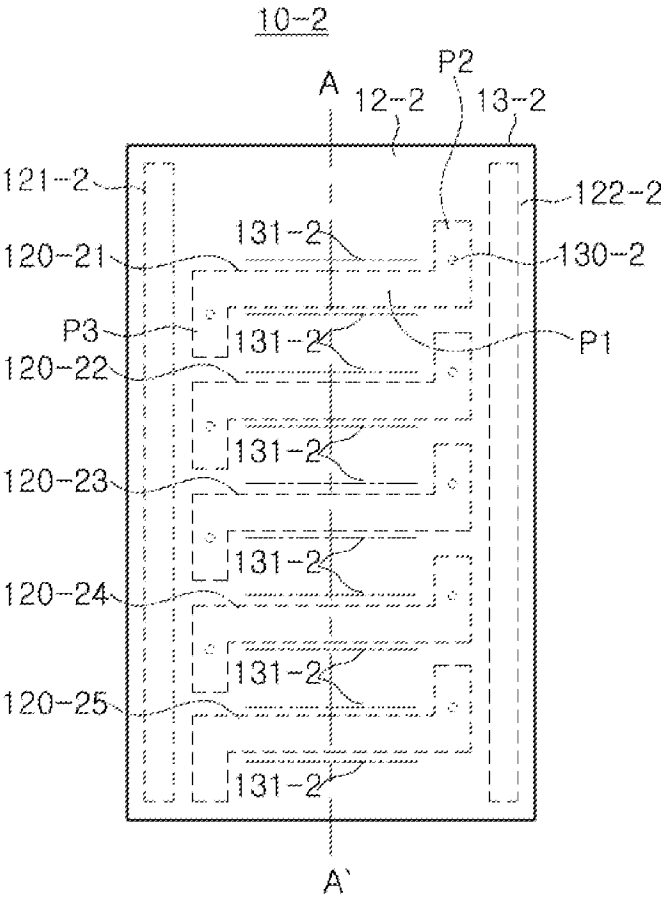
FIGS. 5A and 5B are diagrams schematically showing a coil pattern formed on the substrate of an antenna device, according to another embodiment.
Figure 5A:
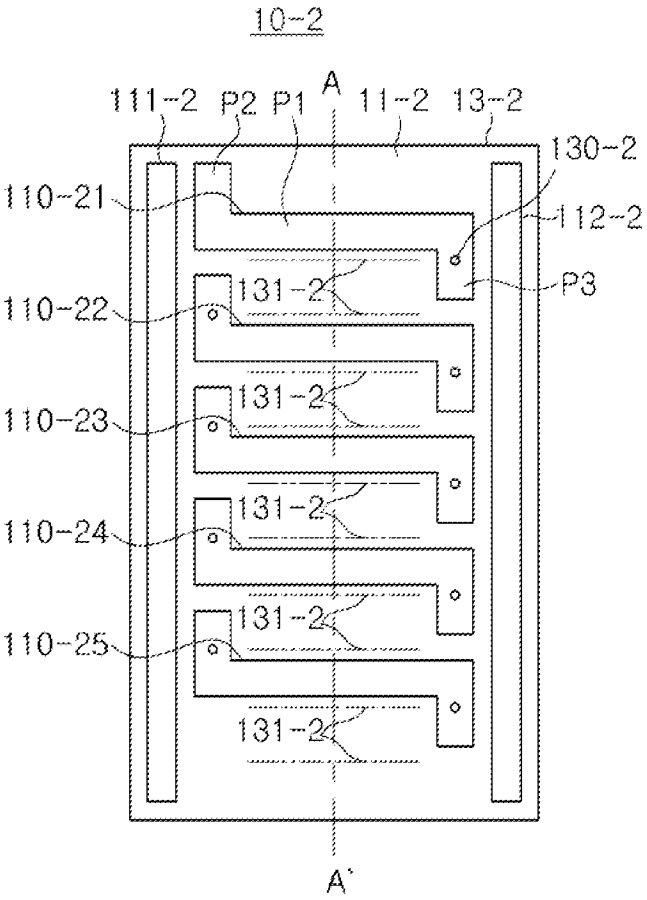

FIGS. 5A and 5B are diagrams schematically showing a coil pattern formed on a substrate 10-2 of an antenna device, according to an embodiment. The substrate 10-2 may include a base layer 13-2, first coil patterns 110-21, 110-22, 110-23, 110-24, and 110-25 formed on a first layer 11-2 disposed on one side of the base layer 13-2, first protective patterns 111-2 and 112-2 formed on a first layer 11-2 disposed on one side of the base layer 13-2, second coil patterns 120-21, 120-22, 120-23, 120-24, and 120-25 formed on the second layer 12-2 on the other side of the base layer 13-2, second protective patterns 121-2 and 122-2 formed on the second layer 12-2 disposed on the other side of the base layer 13-2, and slits 131-2 through which the magnetic body 20 (FIG. 2) passes.

The substrate 10-2 shown in FIGS. 5A and 5B may be the same as the substrate 10 shown in FIGS. 3A and 3B, except that the substrate 10-2 further includes the first protective patterns 111-2 and 112-2 and the second protective patterns 121-2 and 122-2. The first protective patterns 111-2 and 112-2 and the second protective patterns 121-2 and 122-2 may prevent the substrate 10-2 from being torn.

Figure 6B:
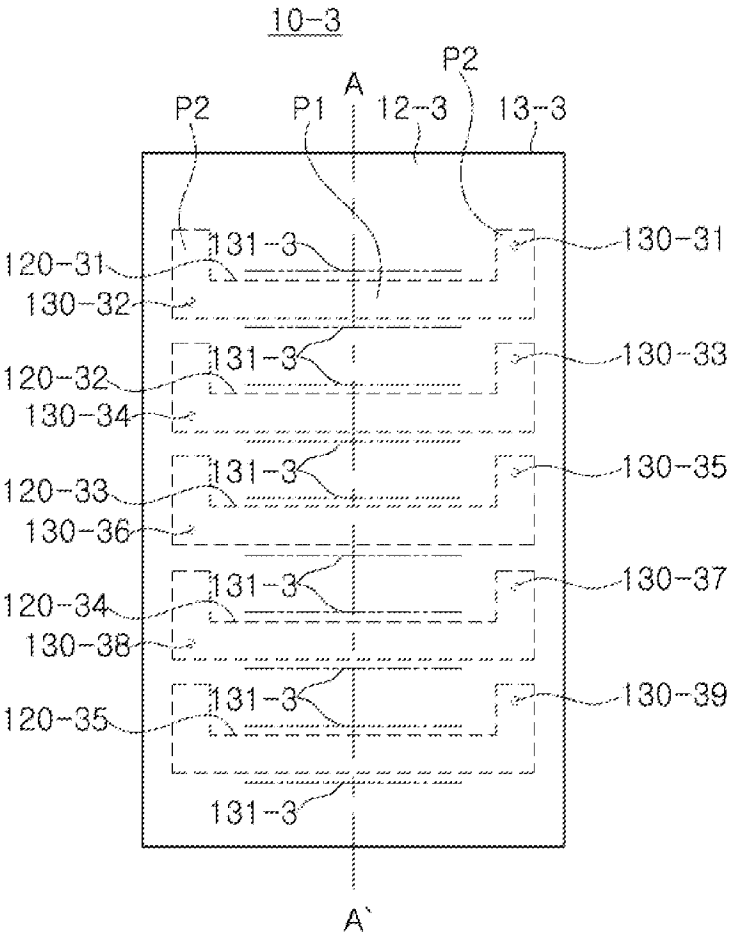
FIGS. 6A and 6B are diagrams schematically showing a coil pattern formed on the substrate of an antenna device, according to another embodiment.
Figure 6A:
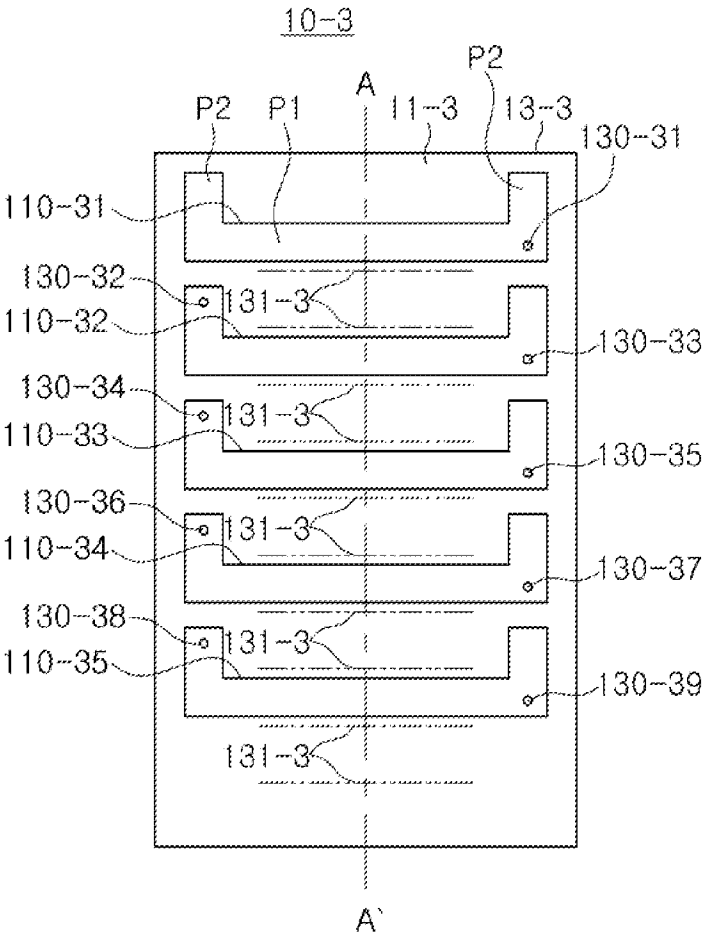

FIGS. 6A and 6B are diagrams schematically showing a coil pattern formed on a substrate 10-3 of an antenna device 1-3 (FIG. 7), according to an embodiment. The substrate 10-3 may include a base layer 13-3, first coil patterns 110-31, 110-32, 110-33, 110-34, and 110-35 formed on a first layer 11-3 disposed on one side of the base layer 13-3, second coil patterns 120-31, 120-32, 120-33, 120-34, and 120-35 formed on a second layer 12-3 disposed on the other side of the base layer 13-3, vias 130-31, 130-32, 130-33, 130-34, 130-35, 130-36, 130-37, 130-38, and 130-39, and slits 131-3 through which the magnetic body 20 (FIG. 2) passes.

Similar to the embodiment shown in FIGS. 3A and 3B, the first coil pattern 110-31 may be connected to the second coil pattern 120-31 through a via 130-31, the second coil pattern 120-31 may be connected to the first coil pattern 110-32 through a via 130-32, the first coil pattern 110-32 may be connected to the second coil pattern 120-32 through a via 130-33, the second coil pattern 120-32 may be connected to the first coil pattern 110-33 through a via 130-34, the first coil pattern 110-33 may be connected to the second coil pattern 120-33 through a via 130-35, the second coil pattern 120-33 may be connected to the first coil pattern 110-34 through a via 130-36, the first coil pattern 110-34 may be connected to the second coil pattern 120-34 through a via 130-37, the second coil pattern 120-34 may be connected to the first coil pattern 110-35 through a via 130-38, and the first coil pattern 110-35 may be connected to the second coil pattern 120-35 through a via 130-39. By the first and second coil patterns 110-31, 110-32, 110-33, 110-34, 110-35, 120-31, 120-32, 120-33, 120-34, and 120-35 being connected in the manner described above, a solenoid coil that surrounds the magnetic body 20 (FIG. 7) may be formed.

Accordingly, a current flowing into the first coil pattern 110-31 may flow through the coil patterns in the order of the second coil pattern 120-31, the first coil pattern 110-32, the second coil pattern 120-32, the first coil pattern 110-33, the second coil pattern 120-33, the first coil pattern 110-34, the second coil pattern 120-34, the first coil pattern 110-35, and the second coil pattern 120-35.

Similar to the description with reference to FIGS. 3A and 3B, the first and second coil patterns 110-31, 110-32, 110-33, 110-34, 110-35, 120-31, 120-32, 120-33, 120-34, and 120-35 each include the main pattern P1 and the connection patterns P2.

The substrate 10-3 shown in FIGS. 6A and 6B is the same as the substrate 10 shown in FIGS. 3A and 3B, except that the connection patterns P2 of each of the coil patterns 110-31, 110-32, 110-33, 110-34, 110-35, 120-31, 120-32, 120-33, 120-34, and 120-35 extend in the same direction based on the main patterns P1, which are connected to each other. That is, each of the first and second coil patterns 110-31, 110-32, 110-33, 110-34, 110-35, 120-31, 120-32, 120-33, 120-34, and 120-35 may include the main pattern P1 and the two connection patterns P2 extending in one direction (upward direction in FIGS. 6A and 6B) from the main pattern P1.

Figure 7:
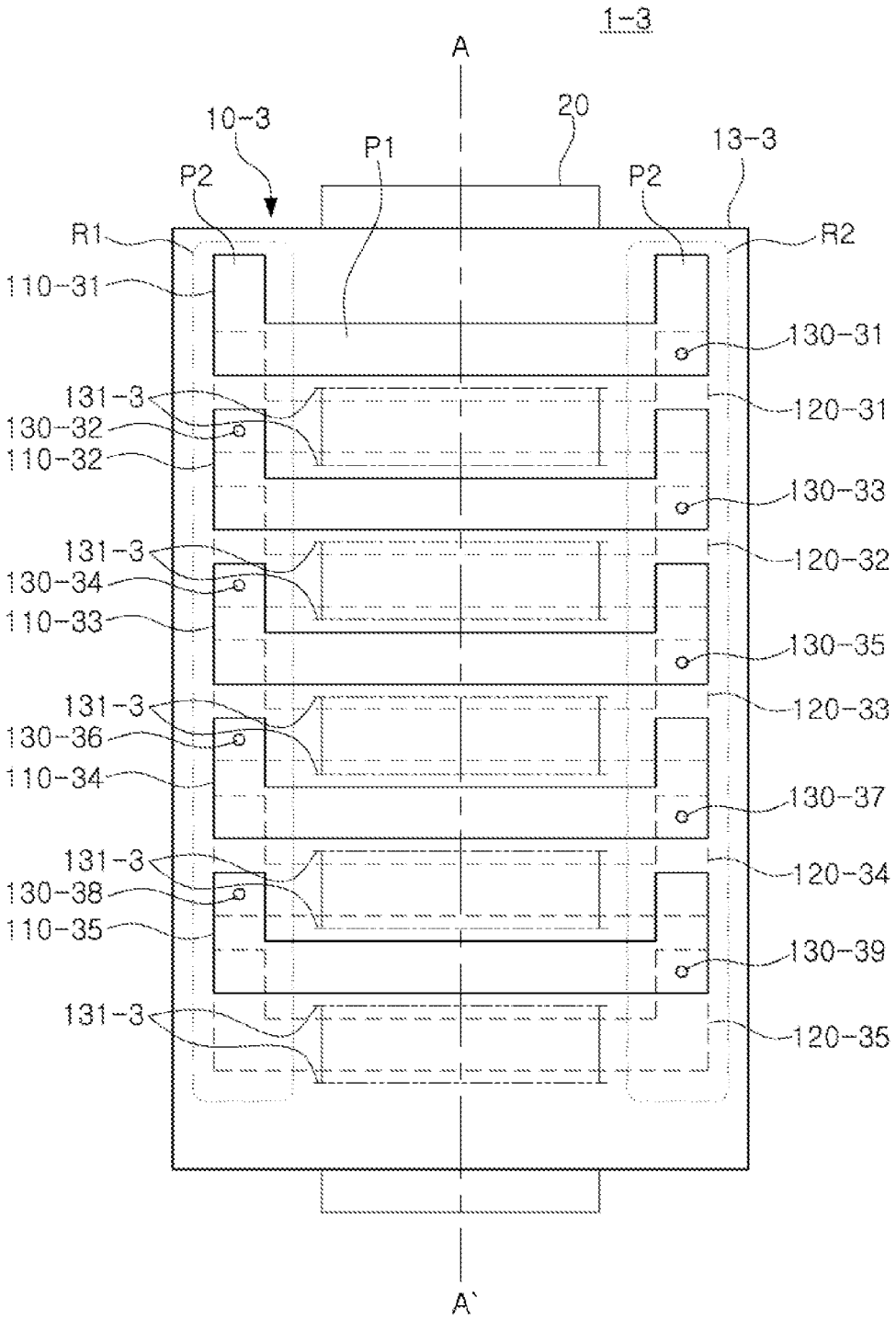
FIG. 7 is a plan view schematically showing the antenna device of FIGS. 6A and 6B.

FIG. 7 is a plan view schematically showing the antenna device 1-3, according to an embodiment.

As shown in FIG. 7, when the antenna device 1-3 is viewed from the top, the connection patterns P2 of each of the first and second coil patterns 110-31, 110-32, 110-33, 110-34, 110-35, 120-31, 120-32, 120-33, 120-34, and 120-35 may extend in the same direction, such that at least one coil pattern may be formed in outer regions R1 and R2 disposed outside the slit 131-3, specifically, a region extending in a vertical direction from the outer portions of the slits 131-3. That is, according to the embodiment shown in FIGS. 6A, 6B, and 7, the connection patterns P2 of each of the first and second coil patterns 110-31, 110-32, 110-33, 110-34, 110-35, 120-31, 120-32, 120-33, 120-34, and 120-35 may not only serve to connect a main pattern P1 to another main pattern P1 through a via, but also perform the same function as the first and second protective patterns 111-2, 112-2, 121-2, and 122-2 shown in FIGS. 5A and 5B. In other words, not only the base layer 13-3 but also at least one coil pattern (specifically, a connection pattern P2 of the coil pattern) is disposed outside the slit 131-3, thereby preventing the substrate 10-3 from being torn.

Figure 8B:
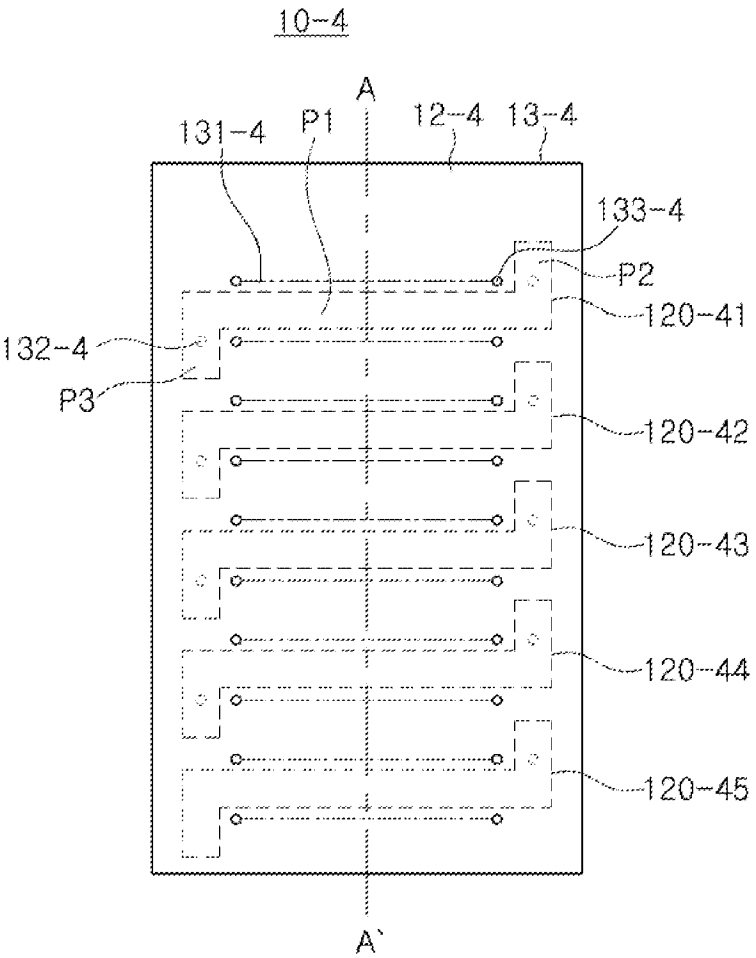
FIGS. 8A and 8B are diagrams schematically showing a coil pattern formed on a substrate of an antenna device, according to another embodiment.
Figure 8A:
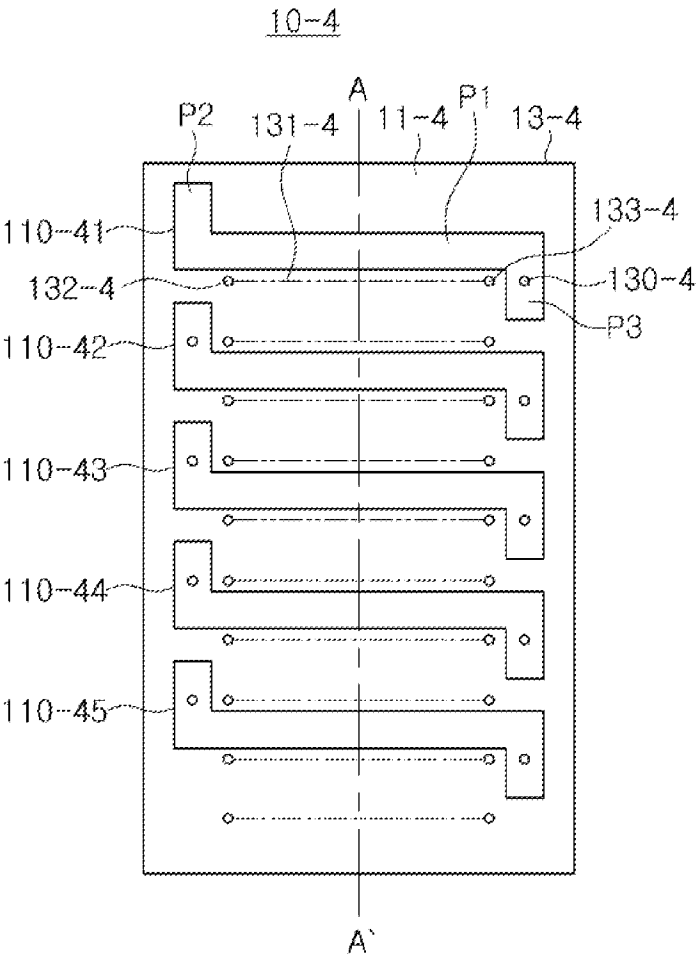

FIGS. 8A and 8B are diagrams schematically showing a coil pattern formed on a substrate 10-4 of an antenna device, according to an embodiment. The substrate 10-4 may include a base layer 13-4, first coil patterns 110-41, 110-42, 110-43, 110-44, and 110-45 formed on a first layer 11-4 disposed on one side of the base layer 13-4, second coil patterns 120-41, 120-42, 120-43, 120-44, and 120-45 formed on a second layer 12-4 disposed on the other side of the base layer 13-4, vias 130-4, slits 131-4 through which the magnetic body 20 (FIG. 2) passes, and protective holes 132-4 and 133-4.

The substrate 10-4 is the same as the substrate 10 of FIGS. 3A and 3B, except that the substrate 10-4 includes the protective holes 132-4 and 133-4.

Each of the protective holes 132-4 may be disposed at one end of a respective slit 132-4, and each of the protective holes 133-4 may be disposed at another end of a respective slit 131-4. The protective holes 132-4 and 133-4 may prevent the substrate from being further torn. The shape of each of the protective holes 132-4 and 133-4 may be circular or polygonal.

Figure 9B:
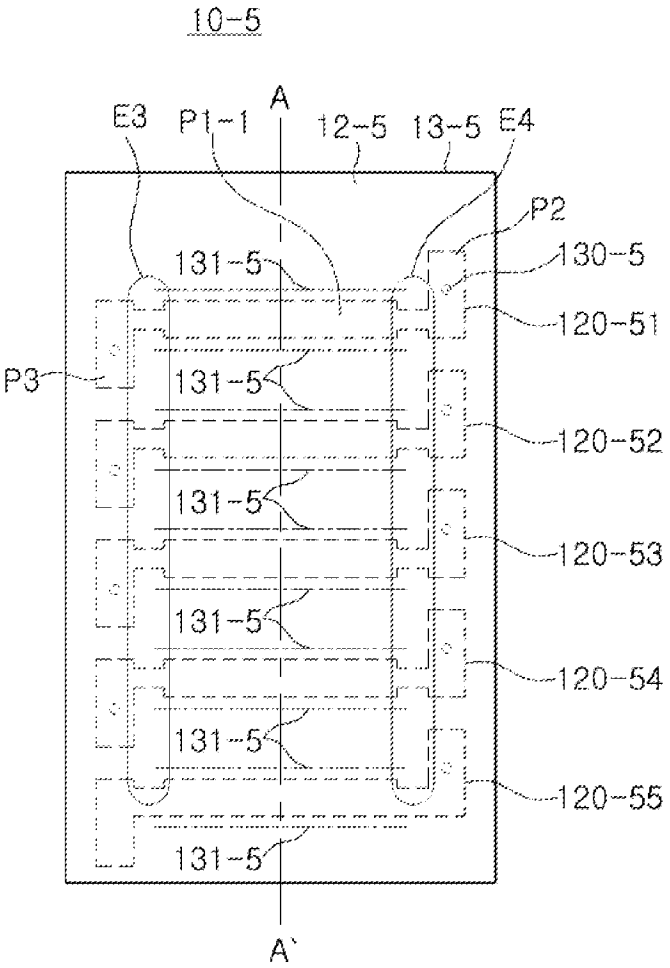
FIGS. 9A and 9B are diagrams schematically showing a coil pattern formed on a substrate of an antenna device, according to another embodiment.
Figure 9A:
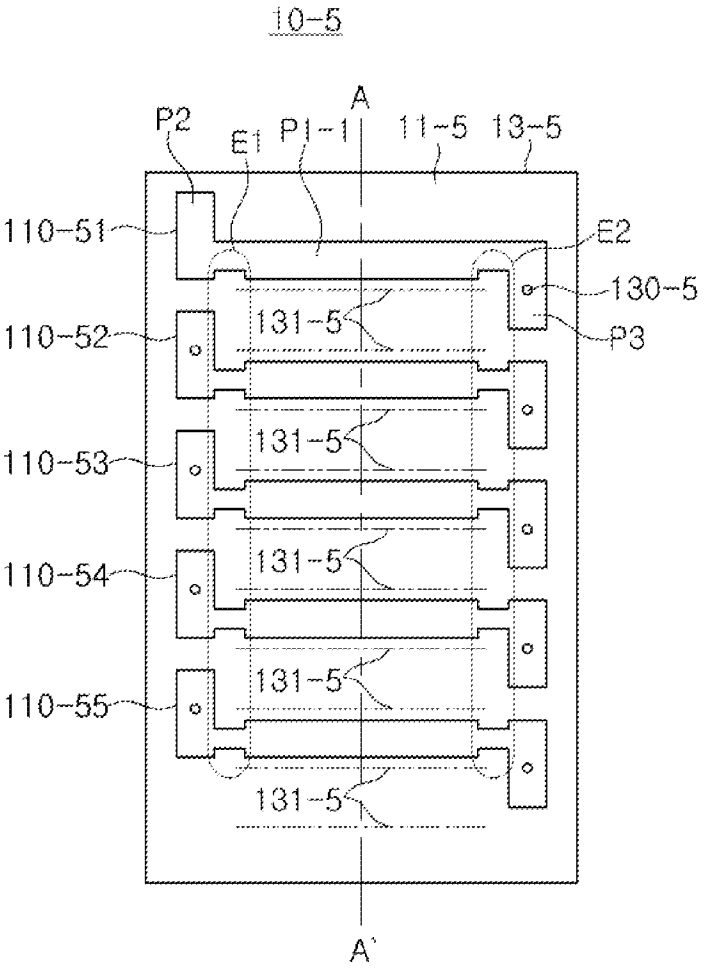

FIGS. 9A and 9B are diagrams schematically showing a coil pattern formed on a substrate 10-5 of an antenna device, according to an embodiment. The substrate 10-5 may include a base layer 13-5, first coil patterns 110-51, 110-52, 110-53, 110-54, and 110-55 formed on a first layer 11-5 disposed on one side of the base layer 13-5, second coil patterns 120-51, 120-52, 120-53, 120-54, and 120-55 formed on a second layer 12-5 disposed on the other side of the base layer 13-5, vias 130-51, 130-52, 130-53, 130-54, 130-55, 130-56, 130-57, 130-58, and 130-59, and slits 131-5 through which the magnetic body 20 (FIG. 2) passes.

The substrate 10-5 shown in FIG. 9 is the same as the substrate 10 shown in FIGS. 3A and 3B, except that the width of both ends of the main patterns P1-1 of each of the first and second coil patterns 110-51, 110-52, 110-53, 110-54, 110-55, 120-51, 120-52, 120-53, 120-54, and 120-55 is narrower than that of an intermediate part of the main patterns P1-1. By this configuration, a gap between adjacent first coil patterns and adjacent second coil patterns may be wider at both ends of each of the slits 131-5. The magnetic body may not be disposed at both ends of the corresponding slits 131-5. Therefore, when the process failure, the introduction of foreign objects, and other defects occur, adjacent first coil patterns and adjacent second coil patterns may easily be short-circuited at both ends of the corresponding slits 131-5. Since the gap between the adjacent first coil patterns and the adjacent second coil patterns is wide at both ends of the corresponding slits 131-5, even if the process failure, the introduction of the foreign objects, and other defects occur, it is possible to prevent the adjacent first coil patterns and the adjacent second coil patterns from being short-circuited.

Cross sections taken along the line A-A' of FIGS. 5, 6, 7, 8, and 9 are similar to that shown in FIG. 4.

Figure 10B:
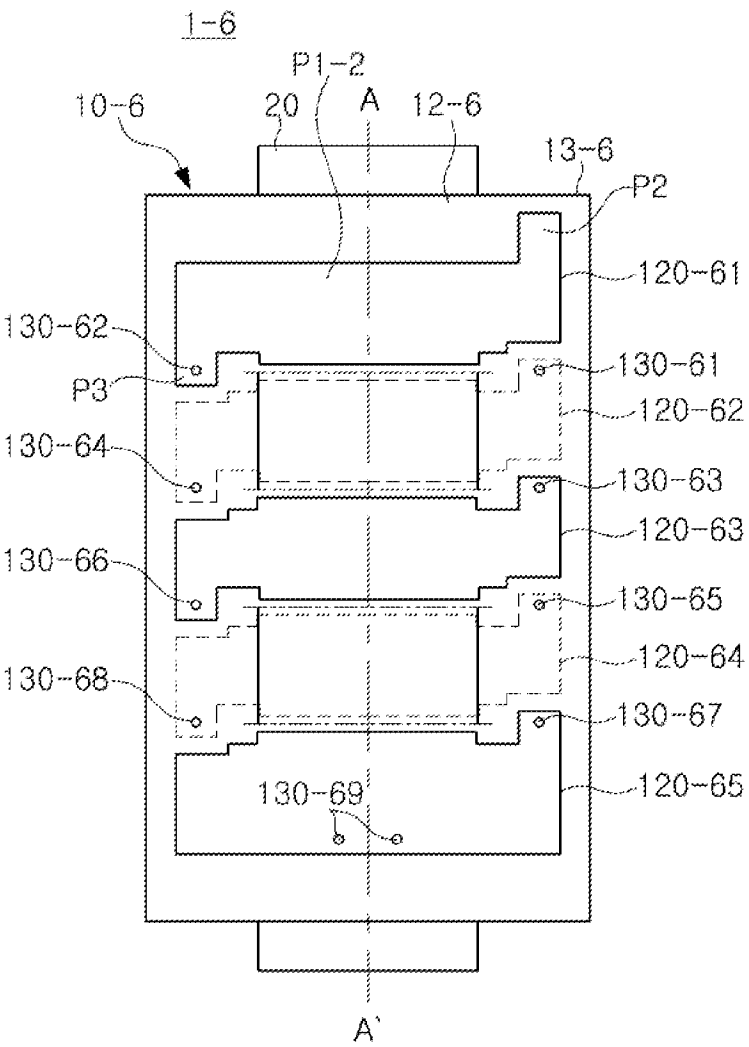
FIGS. 10A and 10B diagrams schematically showing a coil pattern formed on a substrate of an antenna device, according to another embodiment.
Figure 10A:
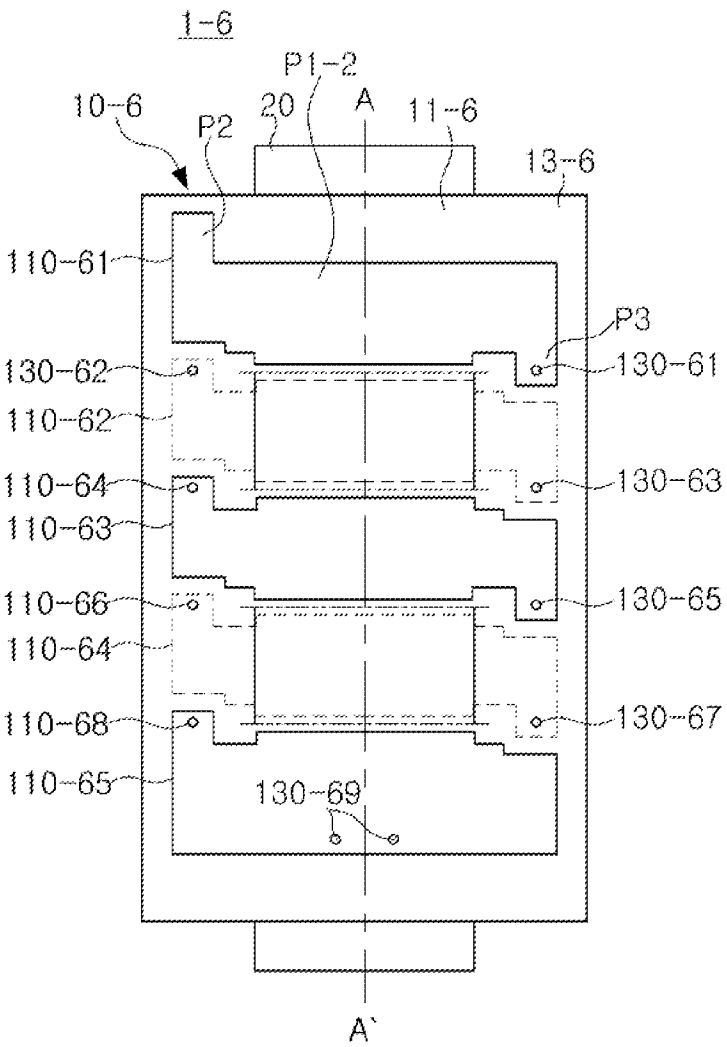

FIGS. 10A and 10B are diagrams schematically showing a coil pattern formed on a substrate 10-6 of an antenna device 1-6, according to an embodiment. The substrate of 10-6 may include a base layer 13-6, first coil patterns 110-61, 110-62, 110-63, 110-64, and 110-65 formed on a first layer 11-6 disposed on one side of the base layer 13-6, second coil patterns 120-61, 120-62, 120-63, 120-64, and 120-65 formed on a second layer 12-6 disposed on the other side of the base layer 13-6, vias 130-61, 130-62, 130-63, 130-64, 130-65, 130-66, 130-67, 130-68, and 130-69, and slits 131-6 through which the magnetic body 20 passes. As shown in FIGS. 10A and 10B, the coil patterns 110-61, 110-62, 110-63, 110-64, 110-65, 120-61, 120-62, 120-63, 120-64, and 120-65 may be arranged in a first direction, and the slits 131-6 may extend in a second direction different from the first direction.

The first coil pattern 110-61 may be connected to the second coil pattern 120-62 through a via 130-61, the second coil pattern 120-62 may be connected to the first coil pattern 110-63 through a via 130-64, the first coil pattern 110-63 may be connected to the second coil pattern 120-64 through a via 130-65, the second coil pattern 120-64 may be connected to the first coil pattern 110-65 through a via 130-68, the first coil pattern 110-65 may be connected to the second coil pattern 110-65 through a via 130-69, the second coil pattern 120-65 may be connected to the first coil pattern 110-64 through a via 130-67, the first coil pattern 110-64 may be connected to the second coil pattern 120-63 through a via 130-66, the second coil pattern 120-63 may be connected to the first coil pattern 110-62 through a via 130-63, and the first coil pattern 110-62 may be connected to the second coil pattern 120-61 through a via 130-62. By being connected in this way, a solenoid coil that surrounds the magnetic body 20 may be formed.

Accordingly, a current flowing into the first coil pattern 110-61 may flow through the coil patterns in the order of the second coil pattern 120-62, the first coil pattern 110-63, the second coil pattern 120-64, the first coil pattern 110-65, the second coil pattern 120-65, the first coil pattern 110-64, the second coil pattern 120-63, the first coil pattern 110-62, and the second coil pattern 120-61.

In addition, the coil patterns 110-61, 110-62, 110-63, 110-64, 110-65, 120-61, 120-62, 120-63, 120-64, and 120-65 each may include a main pattern P1-2 extending in the second direction and connection patterns P2 and P3, which extend in the first direction from the main pattern P1-2 and connected to other coil patterns through the vias 130-61, 130-62, 130-63, 130-64, 130-65, 130-66, 130-67, and 130-68, respectively. The main patterns P1-2 may be formed between the slits 131-6 and the connection patterns P2 and P3 may be disposed at an outside of both ends of the slits 131-6.

When the antenna device 1-6 is viewed from the top, the connection patterns P2 and P3 of each of the first coil patterns 110-61, 110-62, 110-63, 110-64, and 110-65 overlap with corresponding connection patterns P2 and P3 of the second coil patterns 120-61, 120-62, 120-63, 120-64, and 120-65 disposed at the same position. For example, the connection pattern of the first coil pattern 110-61 connected to the via 130-61 and the connection pattern of the second coil pattern 120-62 connected to the via 130-61 partially overlap with each other. Therefore, at least one coil pattern may be formed in the region extending in the vertical direction from the outer region of the slit 131-6, specifically, the outside of the slit 131-6. As a result, it is possible to prevent the substrate 10 from being torn.

Also, similar to the embodiment shown in FIG. 9, the width of the coil first and second coil patterns 110-61, 110-62, 110-63, 110-64, 110-65, 120-61, 120-62, 120-63, 120-64, and 120-65 may be narrow at the ends of each of the slits 131-6. Therefore, it is possible to prevent adjacent first coil patterns and the adjacent second coil patterns from being short-circuited.

FIGS. 10A and 10B show that the width of the first and second coil patterns 110-61, 110-62, 110-63, 110-64, 110-65, 120-61, 120-62, 120-63, 120-64, and 120-65 are narrow at the ends of the corresponding slits 131-6, but, in another example, the width of the first and second coil patterns 110-61, 110-62, 110-63, 110-64, 110-65, 120-61, 120-62, 120-63, 120-64, and 120-65 may not be narrow at the ends of the corresponding slits 131-6.

Although not shown, protective patterns similar to the protective patterns 111-2 and 112 2 shown in FIGS. 5A and 5B may be additionally formed. In this example, the protective patterns may be connected to the other end (i.e., the opposite side to the location where the via 130-61 is formed) of the first coil pattern 110-61 and/or to one end (i.e., the opposite side to the location where the via 130-62 is formed) of the second coil pattern 120-61.

Figure 11:
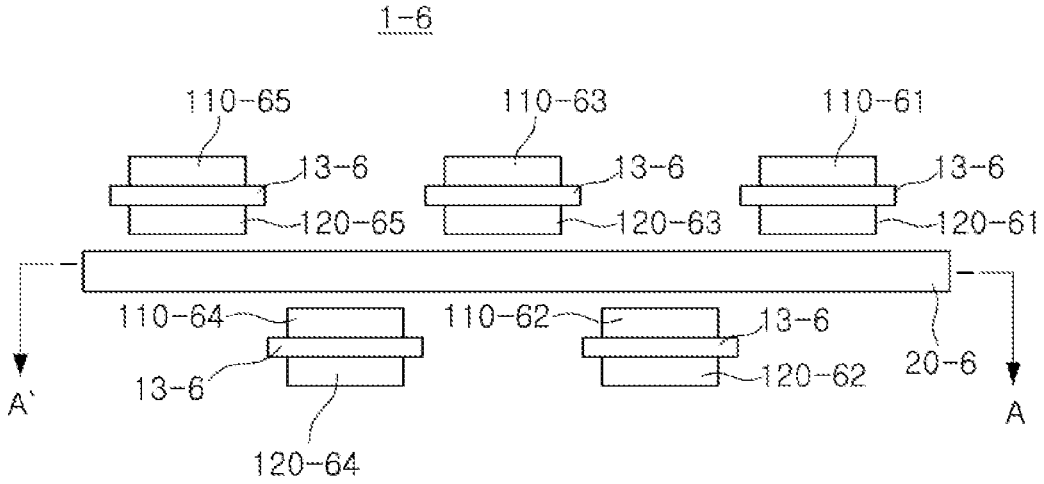
FIG. 11 is a diagram schematically showing a cross section of the antenna device of FIGS. 10A and 10B.

FIG. 11 is a diagram schematically showing a cross section of the antenna device 1-6, taken along the line A-A' of FIGS. 10A and 10B.

As shown in FIG. 11, a part of the substrate 10-6, that is, the first coil patterns 110-61, 110-63, and 110-65, the second coil patterns 120-61, 120-63, and 120-65, and a part of the base layers 13-6 on which these coil patterns are formed may be disposed on one side of the magnetic body 20-6, and the other part of the substrate 10-6, that is, the first coil patterns 110-62 and 110-64, the second coil patterns 120-62 and 120-64, and a part of the base layers 13-6 on which the first and second coil patterns 110-61, 110-63, 110-65, 120-61, 120-63, and 120-65 are formed may be disposed on the other side of the magnetic body 20-6.

The width of the first and second coil patterns 110-61, 110-62, 110-63, 110-64, 110-65, 120-61, 120-62, 120-63, 120-64, and 120-65 may be wide, and the number of turns of the solenoid coil may be the same as the embodiment shown in FIGS. 3A and 3B. Therefore, it is possible to form a coil having a desired number of turns without precision processing.

Figure 12B:
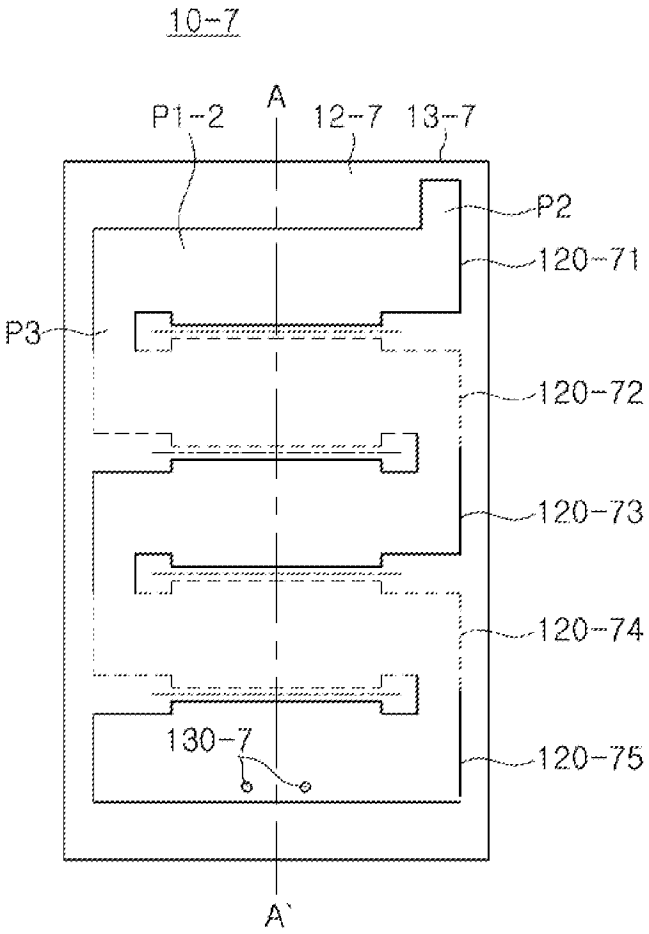
FIGS. 12A and 12B are diagrams schematically showing a coil pattern formed on a substrate of an antenna device, according to another embodiment.
Figure 12A:
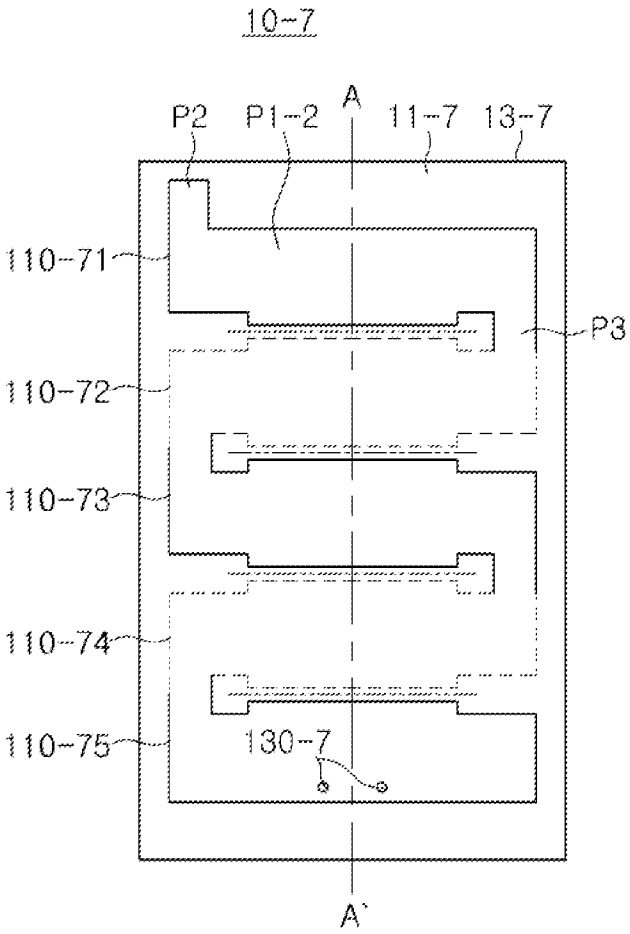

FIGS. 12A and 12B are diagrams schematically showing a coil pattern formed on a substrate 10-7 of an antenna device, according to an embodiment. The substrate 10-7 may include a base layer 13-7, first coil patterns 110-71, 110-72, 110-73, 110-74, and 110-75 formed on a first layer 11-7 disposed on one side of the base layer 13-7, second coil patterns 120-71, 120-72, 120-73, 120-74, and 120-75 formed on a second layer 12-7 disposed on the other side of the base layer 13-7, at least one via 130-7, and slits 130-7 through which the magnetic body 20 (FIG. 2) passes. As shown in FIGS. 12A and 12B, the first and second coil patterns 110-71, 110-72, 110-73, 110-74, 110-75, 120-71, 120-72, 120-73, 120-74, and 120-75 may be arranged in a first direction, and the slits 131-7 may extend in a second direction different from the first direction.

One side of the first coil pattern 110-71 may be connected to one side of the first coil pattern 110-72, and the other side of the first coil pattern 110-72 may be connected to the other side of the first coil pattern 110-73. One side of the first coil pattern 110-73 may be connected to one side of the first coil pattern 110-74, and the other side of the first coil pattern 110-74 may be connected to the other side of the first coil pattern 110-75. The first coil pattern 110-75 may be connected to the second coil pattern 120-75 through at least one via 130-7. One side of the second coil pattern 120-75 may be connected to one side of the second coil pattern 120-74, and the other side of the second coil pattern 120-74 may be connected to the other side of the second coil pattern 120-73. One side of the second coil pattern 120-73 may be connected to one side of the second coil pattern 120-72, and the other side of the second coil pattern 120-72 may be connected to the other side of the second coil pattern 120-71. By the first and second coil patterns 110-71, 110-72, 110-73, 110-74, 110-75, 120-71, 120-72, 120-73, 120-74, and 120-75 being connected in the manner described above, a solenoid coil that surrounds the magnetic body 20 (FIG. 2) may be formed.

Accordingly, a current flowing into the first coil pattern 110-71 may flow through the coil patterns in the order of the first coil pattern 110-72, the first coil pattern 110-73, the first coil pattern 110-74, the first coil pattern 110-75, the second coil pattern 120-75, the second coil pattern 120-74, the second coil pattern 120-73, the second coil pattern 120-72, and the second coil pattern 120-71.

In addition, each of the first and second coil patterns 110-71, 110-72, 110-73, 110-74, 110-75, 120-71, 120-72, 120-73, 120-74, and 120-75 may include the main pattern P1-2 extending in the second direction and the connection patterns P2 and P3 extending in the first direction from the main pattern P1-2. In addition, the main patterns P1-2 of each of the first patterns 110-71, 110-72, 110-73, 110-74, and 110-75 may be formed on the same layer and may be connected to the other adjacent coil patterns through the connection patterns P2 and P3. For example, the main pattern of the first coil pattern 110-71 and the main pattern of the first coil pattern 110-72 may be connected to each other through the connection pattern P3. Similarly, the main patterns P1-2 of each of the second patterns 120-71, 120-72, 120-73, 120-74, and 120-75 may be formed on the same layer and may be connected to the other adjacent coil patterns through the connection patterns P2 and P3.

A cross section taken along the line A-A' of FIGS. 12A and 12B may be similar to that of FIG. 11.

The embodiments shown in FIGS. 3A to 12B may be recombined into various forms. For example, the protective patterns 111-2, 112-2, 121-2, and 122-2 shown in FIGS. 5A and 5B may be applied to the embodiments shown in FIGS. 6A, 6B, 8A, 8B, 9A, 9B, 10A, 10B, 12A, and 12B. Alternatively, the protective holes 132-4 and 133-4 shown in FIGS. 8A and 8B may also be applied to the embodiments shown in FIGS. 3A, 3B, 5A, 5B, 6A, 6B, 9A, 9B, 10A, 10B, 12A, and 12B. Alternatively, the configuration in which the width of the coil pattern is narrow in a region including the end part of the slit, as shown in FIGS. 9A and 9B may also be applied to the embodiments shown in FIGS. 5A, 5B, 6A, and 6B.

Figure 13B:
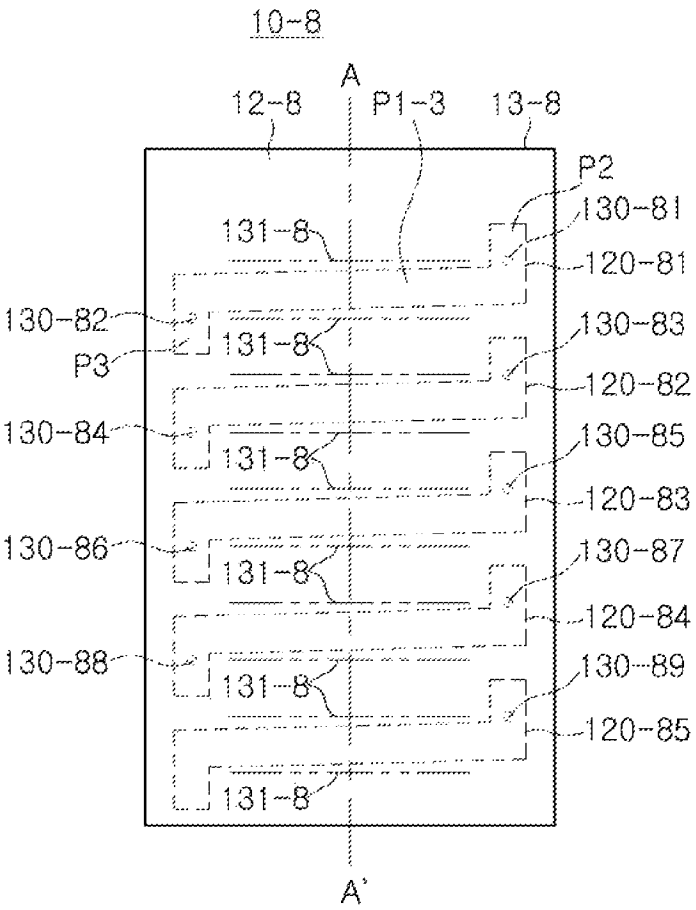
FIGS. 13A and 13B are diagrams schematically showing a coil pattern formed on a substrate of an antenna device, according to another embodiment.
Figure 13A:
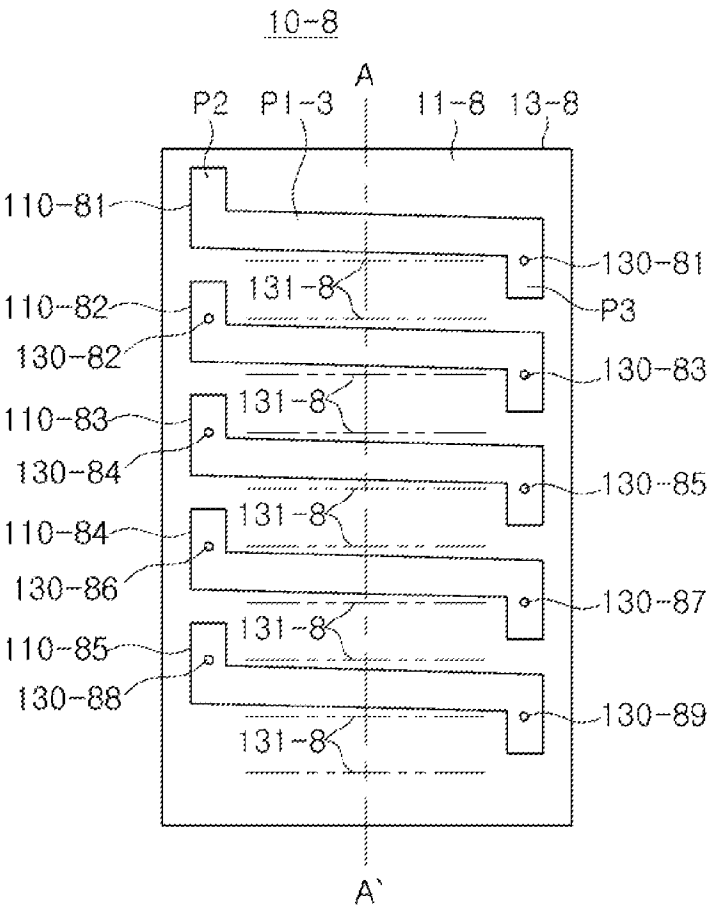

FIGS. 13A and 13B are diagrams schematically showing a coil pattern formed on a substrate 10-8 of an antenna device, according to an embodiment. The substrate 10-8 may include a base layer 13-8, first coil patterns 110-81, 110-82, 110-83, 110-84, and 110-85 formed on a first layer 11-8 disposed on one side of the base layer 13-8, second coil patterns 120-81, 120-82, 120-83, 120-84, and 120-85 formed on a second layer 12-8 disposed on the other side of the base layer 13-8, vias 130-81, 130-82, 130-83, 130-84, 130-85, 130-86, 130-87, 130-88, and 130-89, and slits 131-8 through which the magnetic body 20 (FIG. 2) passes.

The embodiment shown in FIGS. 13A and 13B is the same as the embodiment shown in FIGS. 3A and 3B, except that the main patterns P1-3 of each of the first and second coil patterns 110-81, 110-82, 110-83, 110-84, 110-85, 120-81, 120-82, 120-83, 120-84, and 120-85 extend in the direction having a predetermined angle with respect to a direction in which the slits 131-8 extend, and angles between each of the main patterns P1-3 and the respective connection patterns P2 and P3 are an obtuse angle.

Figure 14B:
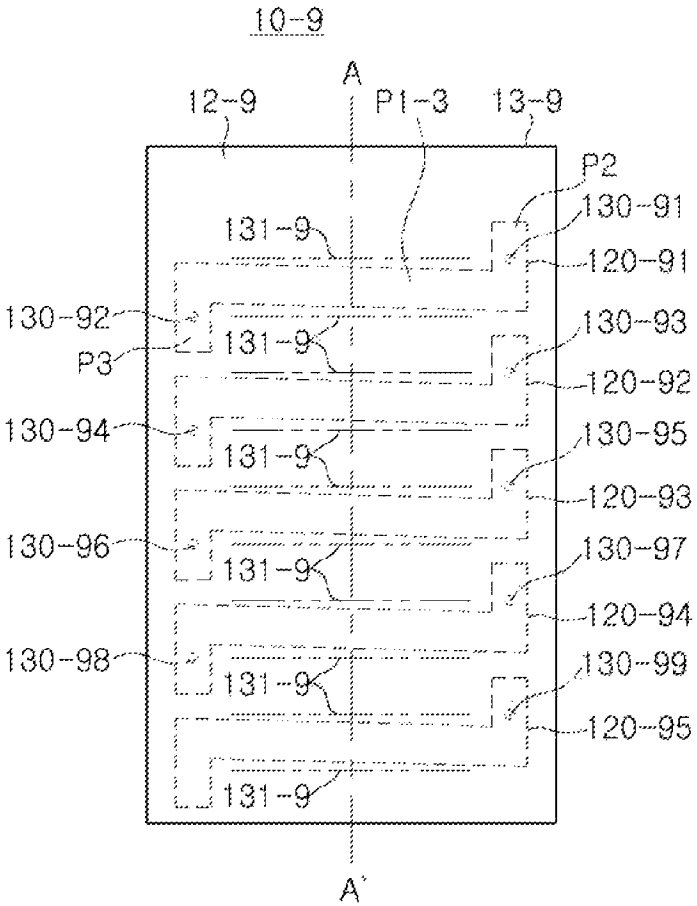
FIGS. 14A and 14B are diagrams schematically showing a coil pattern formed on a substrate of an antenna device, according to another embodiment.
Figure 14A:
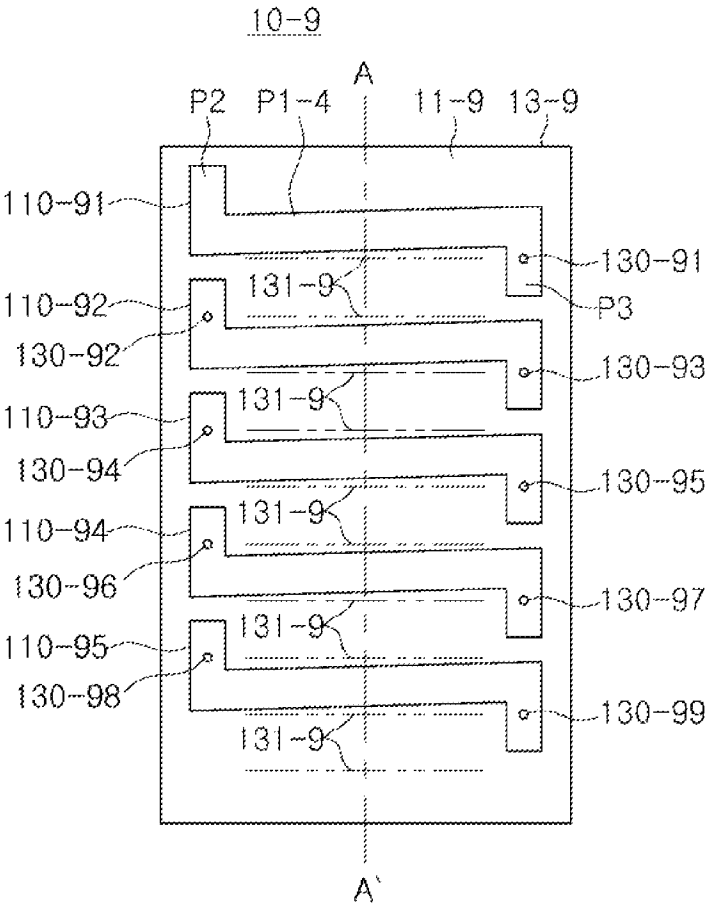

FIGS. 14A and 14B are diagrams schematically showing a coil pattern formed on a substrate 10-9 of an antenna device, according to an embodiment. The substrate 10-9 may include a base layer 13-9, first coil patterns 110-91, 110-92, 110-93, 110-94, and 110-95 formed on a first layer 11-9 disposed on one side of the base layer 13-9, second coil patterns 120-91, 120-92, 120-93, 120-94, and 120-95 formed on a second layer 12-9 disposed on the other side of the base layer 13-9, vias 130-91, 130-92, 130-93, 130-94, 130-95, 130-96, 130-97, 130-98, and 130-99, and slits 131-9 through which the magnetic body 20 (FIG. 2) passes.

The embodiment shown in FIGS. 14A and 14B is the same as the embodiment shown in FIGS. 3A and 3B, except that the main patterns P1-4 of each of the first and second coil patterns 110-91, 110-92, 110-93, 110-94, 110-95, 120-91, 120-92, 120-93, 120-94, and 120-95 extend in the direction having a predetermined angle with respect to the direction in which the slits 131-9 extend, and angles between each of the main patterns P1-4 and the respective connection patterns P2 and P3 are an acute angle.

Figure 15B:
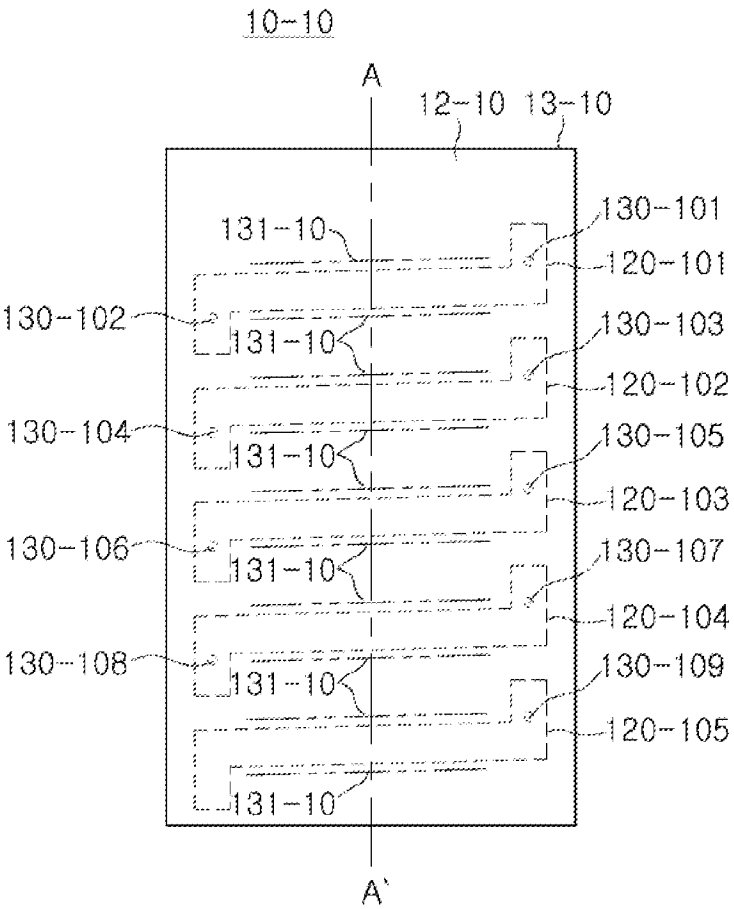
FIGS. 15A and 15B are diagrams schematically showing a coil pattern formed on a substrate of an antenna device, according to another embodiment.
Figure 15A:
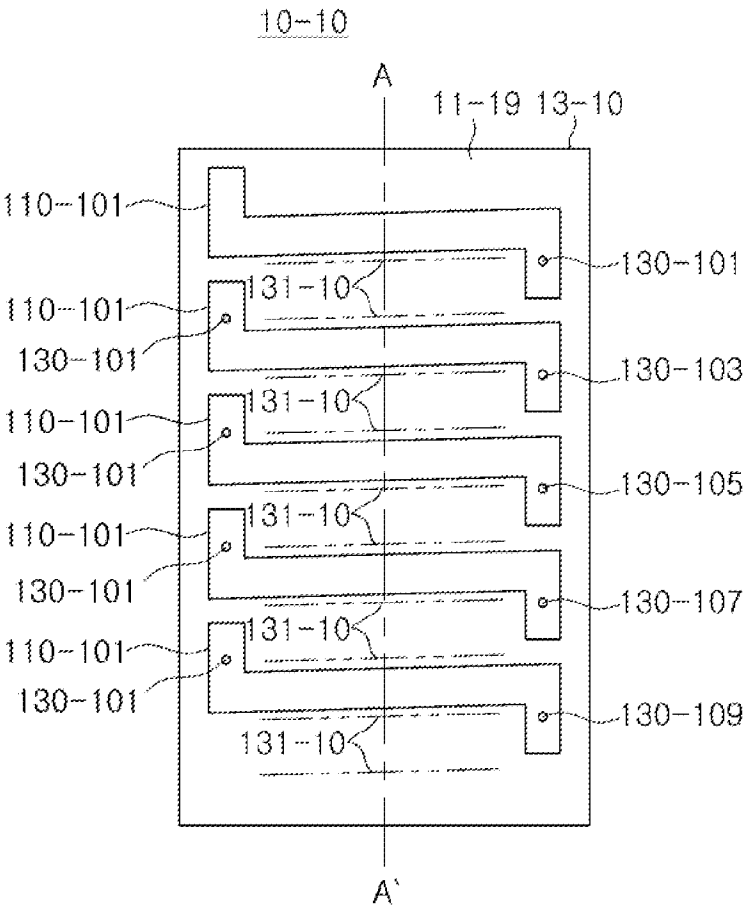

FIGS. 15A and 15B are diagrams schematically showing a coil pattern formed on a substrate 10-10 of an antenna device, according to an embodiment. The substrate 10-10 may include a base layer 13-10, first coil patterns 110-101, 110-102, 110-103, 110-104, and 110-105 formed on a first layer 11-10 disposed on one side of the base layer 13-10, second coil patterns 120-101, 120-102, 120-103, 120-104, and 120-105 formed on a second layer 12-10 disposed on the other side of the base layer 13-10, vias 130-101, 130-102, 130-103, 130-104, 130-105, 130-106, 130-107, 130-108, and 130-109, and slits 131-10 through which the magnetic body 20 (FIG. 2) passes.

The embodiment shown in FIGS. 15A and 15B is the same as the embodiment shown in FIGS. 3A and 3B, except that the direction in which the connection patterns P2 and P3 of each of the first and second coil patterns 110-101, 110-102, 110-103, 110-104, 110-105, 120-101, 120-102, 120-103, 120-104, and 120-105 extend and the direction in which the slits 131-10 extend form an acute angle, the connection patterns P2 and P3 of each of the coil patterns 110-101, 110-102, 110-103, 110-104, 110-105, 120-101, 120-102, 120-103, 120-104, and 120-105 extend in the direction in which the slits 131-10 extend, angles between each of the main patterns P1-5 of the first coil patterns 110-101, 110-102, 110-103, 110-104, and 110-105 and the respective connection patterns P2 and P3 are an acute angle, and angles between the main patterns P1-5 of each of the second coil patterns 120-101, 120-102, 120-103, 120-104, and 120-105 and the respective connection patterns P2 and P3 are an obtuse angle.

In addition to the embodiments shown in FIGS. 13A to 15B, the angles, the arrangement relationship or the like between the coil patterns (specifically, the main patterns and the connection patterns) and the slits may be changed in various ways, if necessary.

As set forth above, in an antenna device and an apparatus including the antenna device according to the embodiments disclosed herein, the antenna device may be manufactured to include an antenna coil having a solenoid shape at a lower cost, such that even when a cover of the apparatus is formed of metal, data may be more accurately transmitted.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna device, comprising:

a substrate comprising a base layer, a first layer on one surface of the base layer, a second layer on another surface of the base layer, at least one first coil pattern on the first layer, and at least one second coil pattern on the second layer; and a magnetic body, wherein a first region of the substrate is on one surface of the magnetic body, and a second region of the substrate is on another surface of the magnetic body, and wherein the at least one first coil pattern and the at least one second coil pattern are connected to each other to form an antenna coil having a solenoid shape around the magnetic body.

2. The antenna device of claim 1, wherein the at least one first coil pattern and the at least one second coil pattern are arranged in a first direction, the substrate further comprises at least one slit extending in a second direction different from the first direction, and the magnetic body passes through the at least one slit.

3. The antenna device of claim 2, wherein the substrate further comprises protective holes formed at two ends of the at least one slit.

4. The antenna device of claim 2, wherein either one or both of the at least one first coil pattern and the at least one second coil pattern comprise an intermediate part and an end part that is narrower than the intermediate part.

5. The antenna device of claim 2, wherein the substrate further comprises at least one protective pattern extending in the first direction and formed on the first layer or the second layer.

6. The antenna device of claim 1, wherein the at least one first coil pattern is formed in the first region, and the at least one second coil pattern is formed in the second region.

7. The antenna device of claim 6, wherein the at least one first coil pattern and the at least one second coil pattern each comprise a main pattern extending in a first direction, and one or more connection patterns extending in a second direction from at least one end of the main pattern, the second direction different from the first direction.

8. The antenna device of claim 7, wherein each of the one or more connection patterns of the first coil pattern is connected to a corresponding one of the one or more connection patterns of the second coil pattern through a via.

9. The antenna device of claim 1, wherein the first coil pattern comprises a first pattern formed in the first region and a second pattern formed in the second region, and the second coil pattern comprises a third pattern formed in the first region and a fourth pattern formed in the second region.

10. The antenna device of claim 9, wherein the first pattern and the fourth pattern are connected to each other through a first via, and the second pattern and the third pattern are connected to each other through a second via.

11. The antenna device of claim 9, wherein the first pattern and the second pattern are connected to each other by a first connection pattern formed on the first layer, and the third pattern and the fourth pattern are connected to each other by a second connection pattern formed on the second layer.

12. An apparatus, comprising:

a main body;

a cover covering a rear surface of the main body; and an antenna device inside the cover, the antenna device including, a substrate comprising a base layer, a first layer on one surface of the base layer, a second layer on another surface of the base layer, at least one first coil pattern on the first layer, and at least one second coil pattern on the second layer, and a magnetic body, wherein a first region of the substrate is on one surface of the magnetic body, and a second region of the substrate is on another surface of the magnetic body, and wherein the at least one first coil pattern and the at least one second coil pattern are connected to each other to form an antenna coil having a solenoid shape around the magnetic body.

13. The apparatus of claim 12, wherein the cover is formed of metal.

14. The apparatus of claim 12, wherein the antenna device is configured to transmit data in a magnetic secure transfer scheme.

15. The apparatus of claim 12, wherein the at least one first coil pattern and the at least one second coil pattern are arranged in a first direction, the substrate further comprises at least one slit extending in a second direction different from the first direction, and the magnetic body passes through the at least one slit.

16. The apparatus of claim 14, wherein either one or both of the at least one first coil pattern and the at least one second coil pattern comprise an intermediate part and an end part that is narrower than the intermediate part.

17. An antenna coil, comprising:

a substrate including, a base layer, a first layer on a first of the base layer, a second layer on another surface of the base layer opposite the first surface of the base layer, first coil patterns on the first layer;

second coil patterns on the second layer, and slits extending through the base layer, the first layer, and the second layer, wherein the slits are configured to receive a magnetic body such that a first region of the substrate is configured to contact a first surface of the magnetic body, and a second region of the substrate is on a second surface of the magnetic body opposite the first surface of the magnetic body, and wherein the first coil patterns and the second coil patterns are connected to each other and are configured to form the antenna coil in a solenoid shape around the magnetic body.

18. The antenna coil of claim 17, wherein each the first coil patterns is connected to a corresponding one of the second coil patterns through a via.

19. The antenna coil of claim 17, wherein the base layer is formed of an insulator, and the first and second layers are formed of a conductor.

20. The antenna coil of claim 17, wherein the first coil patterns and the second coil patterns are arranged in a column in a first direction, and the slits extend in a second direction transverse to the first direction.

* * * * *